US009488015B2

(12) United States Patent
Logan et al.

(10) Patent No.: US 9,488,015 B2
(45) Date of Patent: Nov. 8, 2016

(54) CENTRALIZER FOR DOWNHOLE PROBES

(71) Applicant: Evolution Engineering Inc., Calgary (CA)

(72) Inventors: Aaron W. Logan, Calgary (CA); Justin C. Logan, Calgary (CA); Patrick R. Derkacz, Calgary (CA)

(73) Assignee: Evolution Engineering Inc., Calgary, CA (US)

( * ) Notice: Subject to any disclaimer, the term of this patent is extended or adjusted under 35 U.S.C. 154(b) by 273 days.

(21) Appl. No.: 14/073,757

(22) Filed: Nov. 6, 2013

(65) Prior Publication Data

US 2014/0124269 A1 May 8, 2014

Related U.S. Application Data

(60) Provisional application No. 61/723,287, filed on Nov. 6, 2012.

(51) Int. Cl.

| | |
|---|---|
| ***E21B 17/10*** | (2006.01) |
| ***E21B 17/16*** | (2006.01) |
| ***E21B 23/01*** | (2006.01) |
| ***E21B 23/02*** | (2006.01) |
| ***E21B 47/00*** | (2012.01) |
| ***E21B 47/01*** | (2012.01) |
| ***E21B 7/00*** | (2006.01) |
| ***E21B 47/12*** | (2012.01) |
| ***E21B 17/00*** | (2006.01) |

(52) U.S. Cl.

CPC ..... *E21B 17/1078* (2013.01); *E21B 7/00* (2013.01); *E21B 17/00* (2013.01); *E21B 17/16* (2013.01); *E21B 23/01* (2013.01); *E21B 23/02* (2013.01); *E21B 47/00* (2013.01); *E21B 47/01* (2013.01); *E21B 47/011* (2013.01); *E21B 47/122* (2013.01)

(58) Field of Classification Search

CPC .... E21B 17/1078; E21B 17/00; E21B 47/00; E21B 7/00; E21B 47/122; E21B 47/01; E21B 23/01; E21B 17/16; E21B 23/02; E21B 47/011

See application file for complete search history.

(56) References Cited

U.S. PATENT DOCUMENTS

| | | | |
|---|---|---|---|
| 3,323,327 | A | 6/1967 | Leathers et al. |
| 4,571,215 | A | 2/1986 | Hansen |
| 4,684,946 | A | 8/1987 | Issenmann |
| 4,938,299 | A | 7/1990 | Jelsma |
| 5,236,048 | A | 8/1993 | Skinner et al. |
| 5,247,990 | A | 9/1993 | Sudol et al. |
| 5,474,132 | A | 12/1995 | Gallagher |
| 5,520,246 | A | 5/1996 | Van Steenwyk et al. |

(Continued)

FOREIGN PATENT DOCUMENTS

| | | | |
|---|---|---|---|
| FR | 1303414 | A | 9/1962 |
| GB | 2253428 | A | 9/1992 |

(Continued)

*Primary Examiner* — Brad Harcourt

(74) *Attorney, Agent, or Firm* — Oyen Wiggs Green & Mutala LLP

(57) ABSTRACT

An assembly for use in subsurface drilling includes a downhole probe supported by a centralizer. The centralizer comprises a tubular member that extends around the downhole probe. A wall of the centralizer is fluted to provide inward contact points that support the downhole probe and outward contact points that bear against a bore wall of a section of drill string. The downhole probe may be supported for substantially its entire length.

33 Claims, 9 Drawing Sheets

(56) References Cited

U.S. PATENT DOCUMENTS

| | | | | |
|---|---|---|---|---|
| 5,590,714 | A | 1/1997 | Van Steenwyk et al. | |
| 5,803,193 | A | 9/1998 | Krueger et al. | |
| 5,934,378 | A | 8/1999 | Tchakarov et al. | |
| 6,143,988 | A * | 11/2000 | Neuroth | E21B 17/1085 138/113 |
| 6,429,653 | B1 | 8/2002 | Kruspe et al. | |
| 6,446,736 | B1 | 9/2002 | Kruspe et al. | |
| 6,750,783 | B2 | 6/2004 | Rodney | |
| 6,761,230 | B2 | 7/2004 | Cross et al. | |
| 7,151,466 | B2 | 12/2006 | Gabelmann et al. | |
| 7,243,028 | B2 | 7/2007 | Young et al. | |
| 7,377,325 | B2 | 5/2008 | Trinder et al. | |
| 8,020,634 | B2 | 9/2011 | Utter et al. | |
| D665,824 | S | 8/2012 | Andrigo et al. | |
| 2003/0164240 | A1* | 9/2003 | Vinegar | E21B 17/003 166/372 |
| 2005/0217898 | A1 | 10/2005 | Clark | |
| 2007/0235224 | A1* | 10/2007 | Koger | E21B 17/1007 175/40 |
| 2008/0314585 | A1 | 12/2008 | Clark | |
| 2009/0023502 | A1 | 1/2009 | Koger | |
| 2010/0071960 | A1* | 3/2010 | Curry | E21B 10/25 175/371 |
| 2011/0138903 | A1 | 6/2011 | Large et al. | |

FOREIGN PATENT DOCUMENTS

| | | | |
|---|---|---|---|
| GB | 2406347 | A | 3/2005 |
| WO | 2006083764 | A1 | 8/2006 |
| WO | 2008116077 | A2 | 9/2008 |
| WO | 2012045698 | A1 | 4/2012 |
| WO | 2012082748 | A2 | 6/2012 |

* cited by examiner

CENTRALIZER FOR DOWNHOLE PROBES

CROSS-REFERENCE TO RELATED APPLICATIONS

This application claims the benefit under 35 U.S.C. §119 of U.S. Application No. 61/723,287 filed 6 Nov. 2012 and entitled CENTRALIZER FOR DOWNHOLE PROBES which is hereby incorporated herein by reference for all purposes.

TECHNICAL FIELD

The invention relates to subsurface drilling, more specifically to systems for supporting downhole electronics. Embodiments are applicable to drilling wells for recovering hydrocarbons.

BACKGROUND

Recovering hydrocarbons from subterranean zones relies on the process of drilling wellbores.

Wellbores are made using surface-located drilling equipment which drives a drill string that eventually extends from the surface equipment to the formation or subterranean zone of interest. The drill string can extend thousands of feet or meters below the surface. The terminal end of the drill string includes a drill bit for drilling (or extending) the wellbore. Drilling fluid usually in the form of a drilling "mud" is typically pumped through the drill string. The drilling fluid cools and lubricates the drill bit and also carries cuttings back to the surface. Drilling fluid may also be used to help control bottom hole pressure to inhibit hydrocarbon influx from the formation into the wellbore and potential blow out at the surface.

Bottom hole assembly (BHA) is the name given to the equipment at the terminal end of a drill string. In addition to a drill bit a BHA may comprise elements such as: apparatus for steering the direction of the drilling (e.g. a steerable downhole mud motor or rotary steerable system); sensors for measuring properties of the surrounding geological formations (e.g. sensors for use in well logging); sensors for measuring downhole conditions as drilling progresses; one or more systems for telemetry of data to the surface; stabilizers; heavy weight drill collars, pulsers and the like. The BHA is typically advanced into the wellbore by a string of metallic tubulars (drill pipe).

Modern drilling systems may include any of a wide range of electronics systems in the BHA or at other downhole locations. Such electronics may include sensors for collecting data of various kinds, controls for downhole equipment, signal processing systems, data telemetry systems etc. Supporting and protecting downhole electronics is important as a downhole electronics package may be subjected to high pressures (20,000 p.s.i. or more in some cases), along with severe shocks and vibrations.

There are references that describe various centralizers that may be useful for supporting a downhole electronics package centrally in a bore within a drill string. The following is a list of some such references: US2007/0235224; US2005/0217898; U.S. Pat. No. 6,429,653; U.S. Pat. No. 3,323,327; U.S. Pat. No. 4,571,215; U.S. Pat. No. 4,684,946; U.S. Pat. No. 4,938,299; U.S. Pat. No. 5,236,048; U.S. Pat. No. 5,247,990; U.S. Pat. No. 5,474,132; U.S. Pat. No. 5,520,246; U.S. Pat. No. 6,429,653; U.S. Pat. No. 6,446,736; U.S. Pat. No. 6,750,783; U.S. Pat. No. 7,151,466; U.S. Pat. No. 7,243,028; US2009/0023502; WO 2006/083764; WO 2008/116077; WO 2012/045698; and WO 2012/082748.

U.S. Pat. No. 5,520,246 issued May 28, 1996 discloses apparatus for protecting instrumentation placed within a drill string. The apparatus includes multiple elastomeric pads spaced about a longitudinal axis and protruding in directions radially to the axis. The pads are secured by fasteners.

US 2005/0217898 published Oct. 6, 2005 describes a drill collar for dampening downhole vibration in the tool-housing region of a drill string. The collar has a hollow cylindrical sleeve having a longitudinal axis and an inner surface facing the longitudinal axis. Multiple elongate ribs are mounted to the inner surface and extend parallel to the longitudinal axis.

Telemetry information can be invaluable for efficient drilling operations. For example, telemetry information may be used by a drill rig crew to make decisions about controlling and steering the drill bit to optimize the drilling speed and trajectory based on numerous factors, including legal boundaries, locations of existing wells, formation properties, hydrocarbon size and location, etc. A crew may make intentional deviations from the planned path as necessary based on information gathered from downhole sensors and transmitted to the surface by telemetry during the drilling process. The ability to obtain and transmit reliable data from downhole locations allows for relatively more economical and more efficient drilling operations.

Various techniques have been used to transmit information from a location in a bore hole to the surface. These include transmitting information by generating vibrations in fluid in the bore hole (e.g. acoustic telemetry or mud pulse telemetry) and transmitting information by way of electromagnetic signals that propagate at least in part through the earth (EM telemetry). Other telemetry systems use hardwired drill pipe, fibre optic cable, or drill collar acoustic telemetry to carry data to the surface.

A typical arrangement for electromagnetic telemetry uses parts of the drill string as an antenna. The drill string may be divided into two conductive sections by including an insulating joint or connector (a "Gap sub") in the drill string. The gap sub is typically placed at the top of a bottom hole assembly such that metallic drill pipe in the drill string above the BHA serves as one antenna element and metallic sections in the BHA serve as another antenna element. Electromagnetic telemetry signals can then be transmitted by applying electrical signals between the two antenna elements. The signals typically comprise very low frequency AC signals applied in a manner that codes information for transmission to the surface. The electromagnetic signals may be detected at the surface, for example by measuring electrical potential differences between the drill string or a metal casing that extends into the ground and one or more ground rods. A challenge with EM telemetry is that the generated signals are significantly attenuated as they propagate to the surface. Further, the electrical power available to generate EM signals May be provided by batteries or another power source that has limited capacity. Therefore, it is desirable to provide a system in which EM signals are generated efficiently.

Design of the gap sub is an important factor in an EM telemetry system. The gap sub must provide electrical isolation between two parts of the drill string as well as withstand the extreme mechanical loading induced during drilling and the high differential pressures that occur between the center and exterior of the drill pipe. Drill string components are typically made from high strength, ductile metal alloys in order to handle the loading without failure.

Most electrically-insulating materials suitable for electrically isolating different parts of a gap sub are weaker than metals (e.g. rubber, plastic, epoxy) or quite brittle (ceramics). This makes it difficult to design a gap sub that is both configured to provide efficient transmission of EM telemetry signals and has the mechanical properties required of a link in the drill string.

There remains a need for ways to support electronics systems at downhole locations in a way that provides at least some protection against mechanical shocks and vibrations and other downhole conditions.

SUMMARY

The invention has a number of aspects. One aspect provides centralizers for downhole probes as may be used, for example in subsurface drilling. Such centralizers may have features or combinations of features as described herein. Other aspects of the invention provide downhole apparatus and systems that include centralizers and associated methods.

One example aspect of the invention provides a centralizer useful for subsurface drilling. The centralizer comprises: an elongated tubular member having a wall formed to provide a cross-section that provides first outwardly-convex and inwardly-concave lobes. The first lobes are arranged to contact a bore wall of a bore in a section of a drill string at a plurality of spots spaced apart around a circumference of the bore wall. The centralizer also comprises a plurality of inwardly-projecting portions. Each of the plurality of inwardly-projecting portions are arranged between two adjacent ones of the plurality of first lobes.

Different embodiments may provide different numbers of first lobes. Example embodiments have 2 to 8 first lobes. The first lobes may extend along the centralizer to provide longitudinal ridges. The ridges may be straight but, in the alternative, may be formed to twist in helices around a longitudinal axis of the centralizer.

In a related embodiment of the centralizer, the inwardly-projecting portions comprise inwardly projecting lobes that are inwardly-convex and outwardly-concave.

In a further related embodiment of the centralizer, a thickness of the wall is substantially uniform.

In another related embodiment of the centralizer, the first lobes are equally angularly separated around a longitudinal centerline of the centralizer.

In yet another embodiment of the centralizer, each of the plurality of first lobes has a radius of curvature that is less than a radius of a smallest circle enclosing the centralizer.

Another example aspect of the invention provides a downhole assembly. The assembly comprises: a drill string section having a bore extending longitudinally through the drill string section, an electronics package or other probe located in the bore of the section and a centralizer in the bore. The centralizer comprises a tubular member having a wall extending around the electronics package. The wall is formed to contact an inside surface of the bore and an outside surface of the electronics package. A cross-section of the wall follows a path around the electronics package that zig zags back and forth between the outside surface of the electronics package and the inside surface of the bore wall (e.g. following the path around the cross section, the path has inner portions that contact the outside of the electronics package but do not contact the inside of the bore that alternate with outer portions that contact the inside surface of the bore. Between these portions are portions of the path that extend through the bore to join the inner portions and outer portions of the path).

In a related embodiment to the downhole assembly, the wall divides an annular region within the bore surrounding the electronics package into a plurality of channels. A plurality of the channels are inside the wall of the centralizer and a plurality of the channels are outside the wall of the centralizer.

Another example aspect of the invention provides a downhole assembly. The assembly comprises: a drill string section having a bore extending longitudinally through the drill string section, an electronics package or other probe located in the bore of the section, a centralizer in an annular region of the bore surrounding the electronics package. The centralizer comprises a tubular member having a wall arranged to define a first plurality of channels inside the wall and a second plurality of channels outside the wall.

Another example aspect of the invention provides another downhole assembly. The assembly comprises: a drill string section having a bore extending longitudinally through the drill string section, an electronics package or other probe located in the bore of the section and a centralizer in the bore. The centralizer comprises a tubular member having a wall extending around the electronics package in a closed path. The wall is formed to define a plurality of angularly spaced-apart portions in contact with an inside surface of the bore and a plurality of angularly-spaced apart portions in contact with an outside surface of the electronics package. Each of the plurality of angularly-spaced apart portions in contact with an outside surface of the electronics package are angularly located between two adjacent ones of the plurality of angularly spaced-apart portions in contact with the inside surface of the bore.

Further aspects of the invention and non-limiting example embodiments of the invention are illustrated in the accompanying drawings and/or described in the following description.

BRIEF DESCRIPTION OF THE DRAWINGS

The accompanying drawings illustrate non-limiting example embodiments of the invention.

DESCRIPTION

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the system to the precise forms of any example embodiment. Accordingly, the description and drawings are to be regarded in an illustrative, rather than a restrictive, sense.

Figure 1:
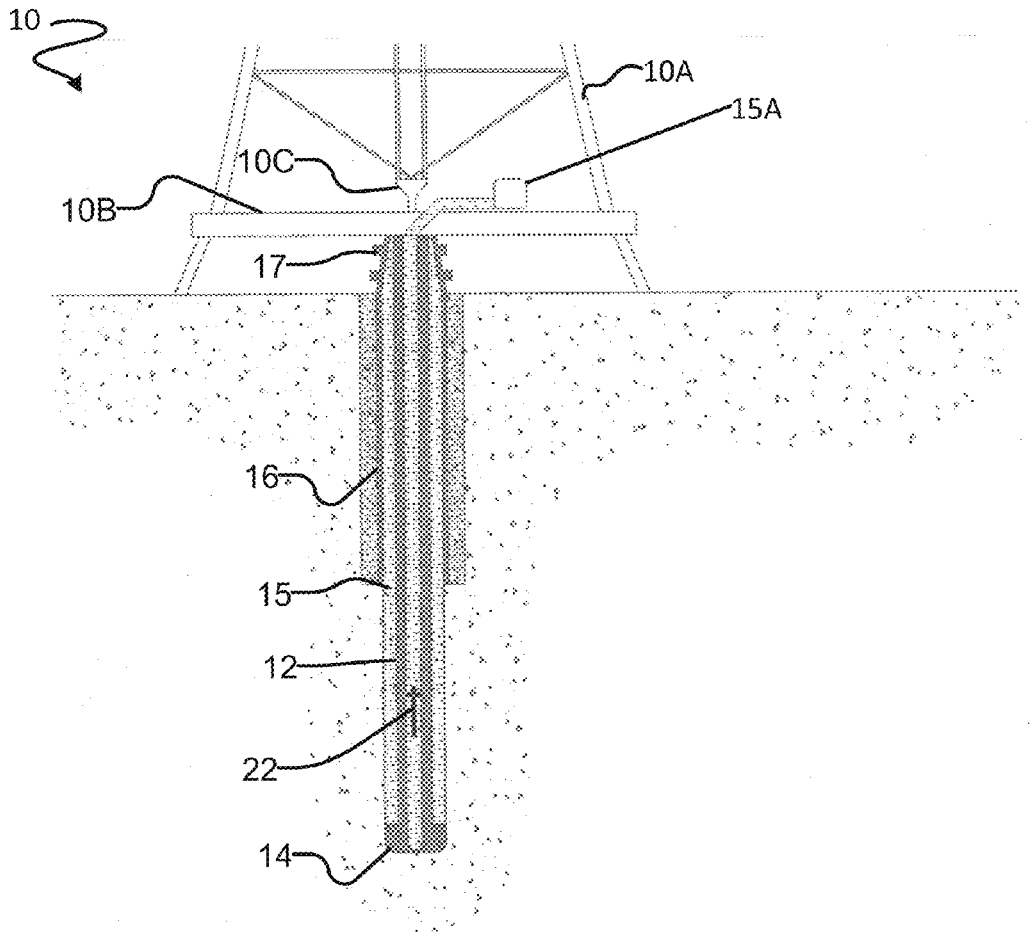
FIG. 1 is a schematic view of a drilling operation according to one embodiment of the invention.

FIG. 1 shows schematically an example drilling operation. A drill rig 10 drives a drill string 12 which includes sections of drill pipe that extend to a drill bit 14. The illustrated drill rig 10 includes a derrick 10A, a rig floor 10B and draw works 10C for supporting the drill string. Drill bit 14 is larger in diameter than the drill string above the drill bit. An annular region 15 surrounding the drill string is typically filled with drilling fluid. The drilling fluid is pumped by a pump 15A through a bore in the drill string to the drill bit and returns to the surface through annular region 15 carrying cuttings from the drilling operation. As the well is drilled, a casing 16 may be made in the well bore. A blow out preventer 17 is supported at a top end of the casing. The drill rig illustrated in FIG. 1 is an example only. The methods and apparatus described herein are not specific to any particular type of drill rig.

Drill string 12 includes a downhole probe. Here the term 'probe' encompasses any active mechanical, electronic, and/or electromechanical system. A probe may provide any of a wide range of functions including, without limitation, data acquisition, sensing, data telemetry, control of downhole equipment, status monitoring for downhole equipment, collecting data by way of sensors that may include one or more of vibration sensors, magnetometers, nuclear particle detectors, electromagnetic detectors, acoustic detectors, and others, emitting signals, particles or fields for detection by other devices, etc. Some downhole probes are highly specialized and expensive. Downhole conditions can be harsh. Exposure to these harsh conditions, which can include high temperatures, vibrations, shocks, and immersion in various drilling fluids can shorten the lifespan of downhole probes.

The following description describes an electronics package 22 which is one example of a downhole probe. However, the probe is not limited to electronics packages and, in some embodiments, could comprise mechanical or other non-electronic systems. Electronics package 22 comprises a housing enclosing electric circuits and components providing desired functions.

Electronics package 22 typically has an elongated cylindrical body. The body may, for example, comprise a metal tube designed to withstand downhole conditions. The body may, for example, have a length in the range of 1 to 20 meters.

Downhole electronics package 22 may optionally include a telemetry system for communicating information to the surface in any suitable manner. In some example embodiments a telemetry system is an electromagnetic (EM) telemetry system however other modes of telemetry may be provided instead of or in addition.

Figure 1A:
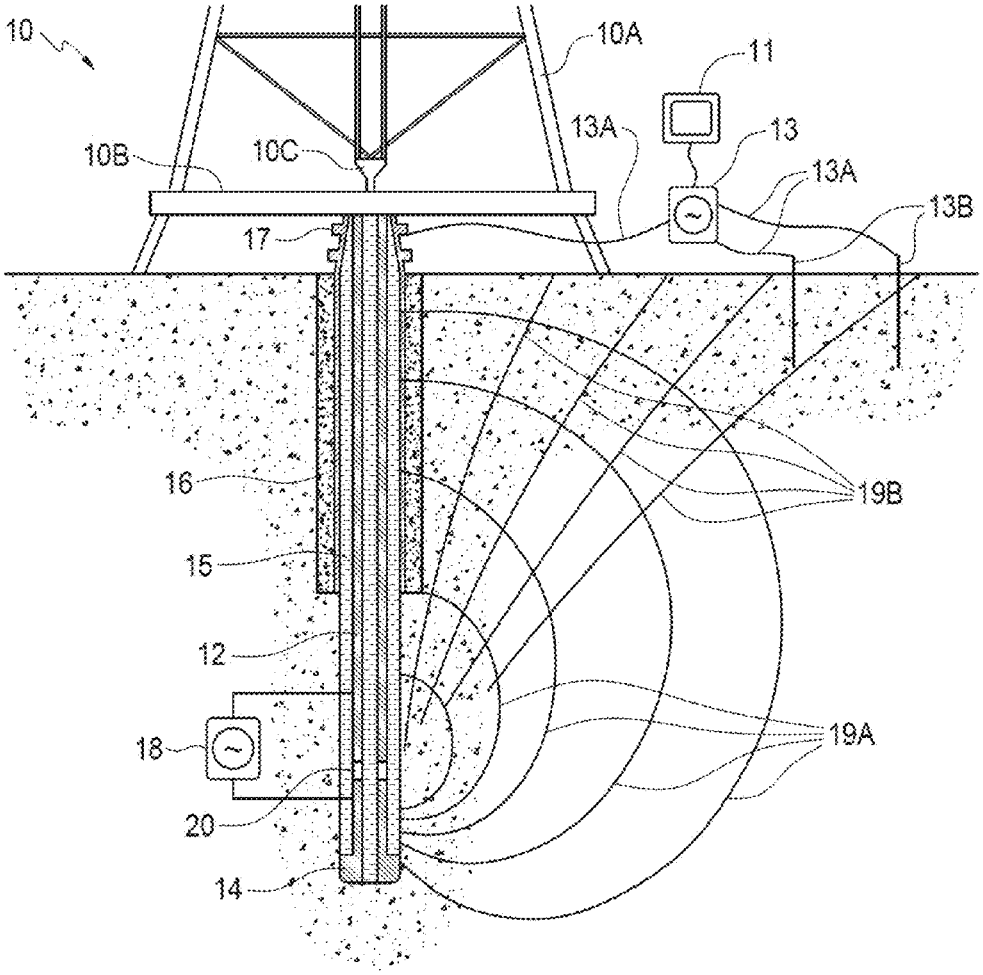
FIG. 1A is a schematic view of a drilling operation according to another embodiment of the invention.

FIG. 1A shows an example EM telemetry system, where electronics package 22 comprises an EM telemetry signal generator 18 that is electrically connected across the electrically-insulating gap of a gap sub 20. The signals from the EM signal generator result in electrical currents 19A and electric fields 19B that are detectable at the surface. In the illustrated embodiment a signal receiver 13 is connected by signal cables 13A to measure potential differences between electrical grounding stakes 13B and the top end of drill string 12. A display 11 may be connected to display data received by the signal receiver 13.

Figure 2:
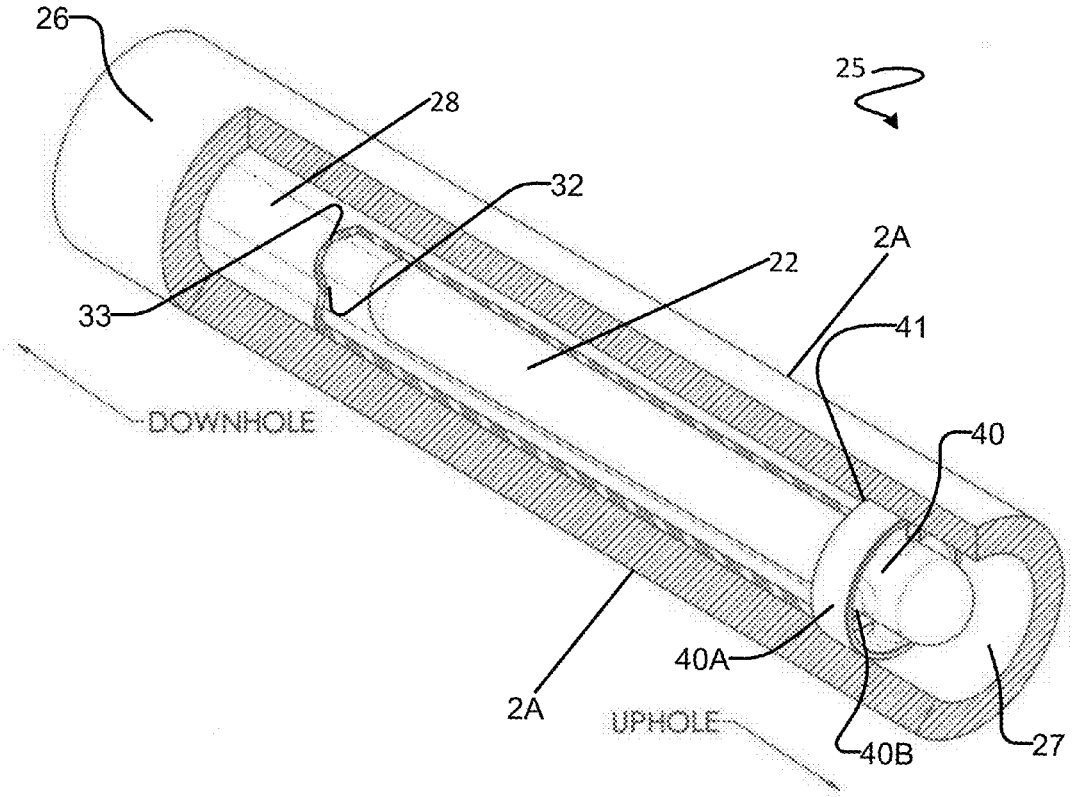
FIG. 2 is a perspective cutaway view of a downhole assembly containing an electronics package.
Figure 2A:
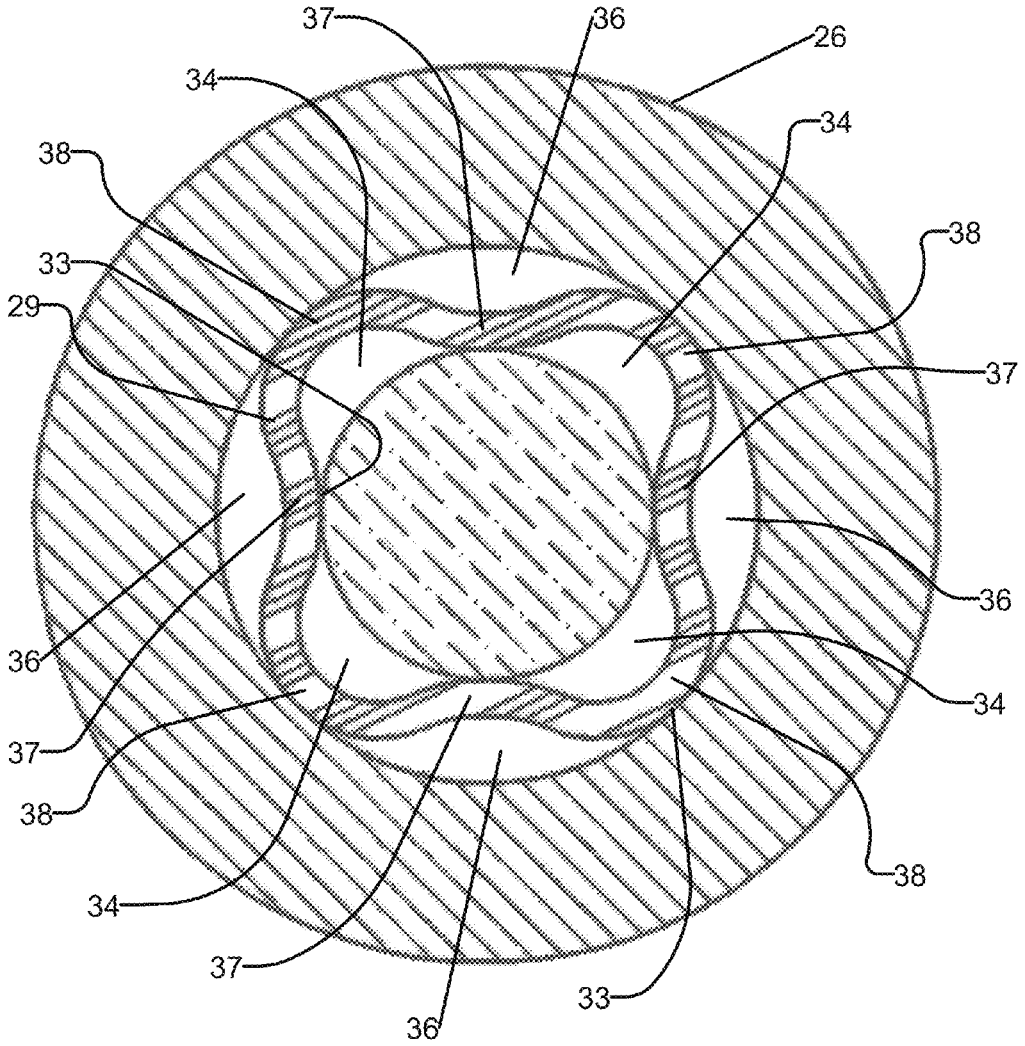
FIG. 2A is a view taken in section along the line 2A-2A of FIG. 2.
Figure 2B:
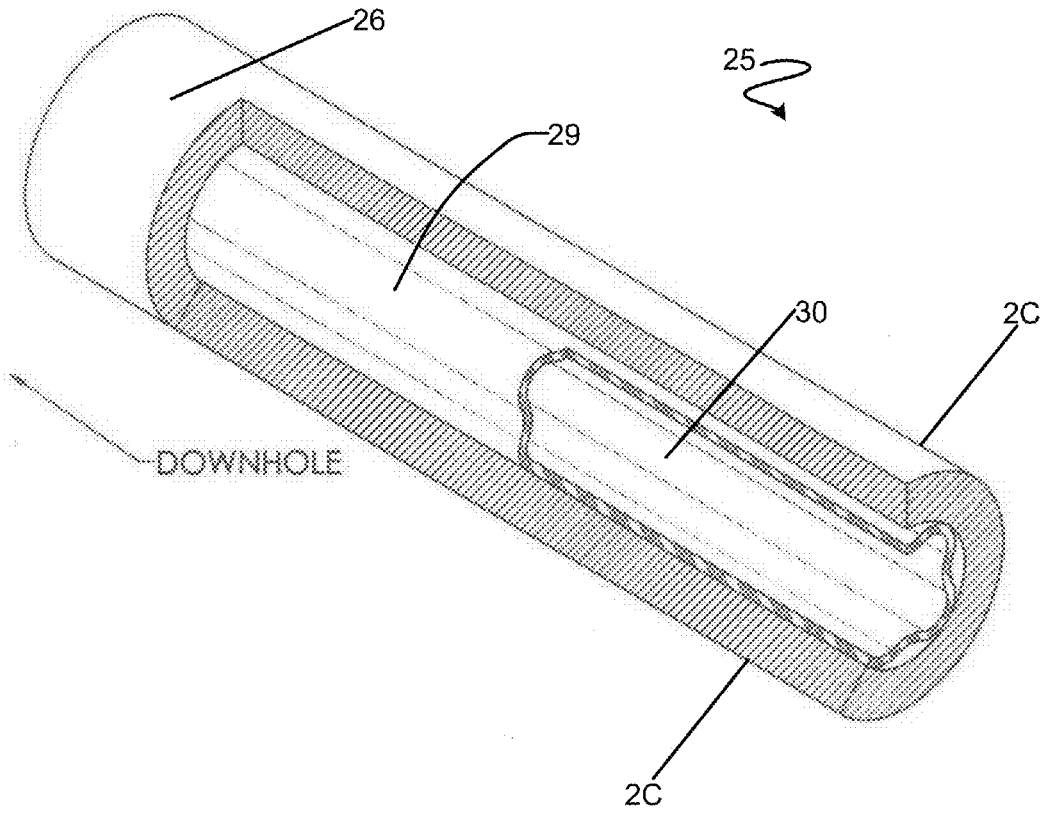
FIG. 2B is a perspective cutaway view of a downhole assembly not containing an electronics package.
Figure 2C:
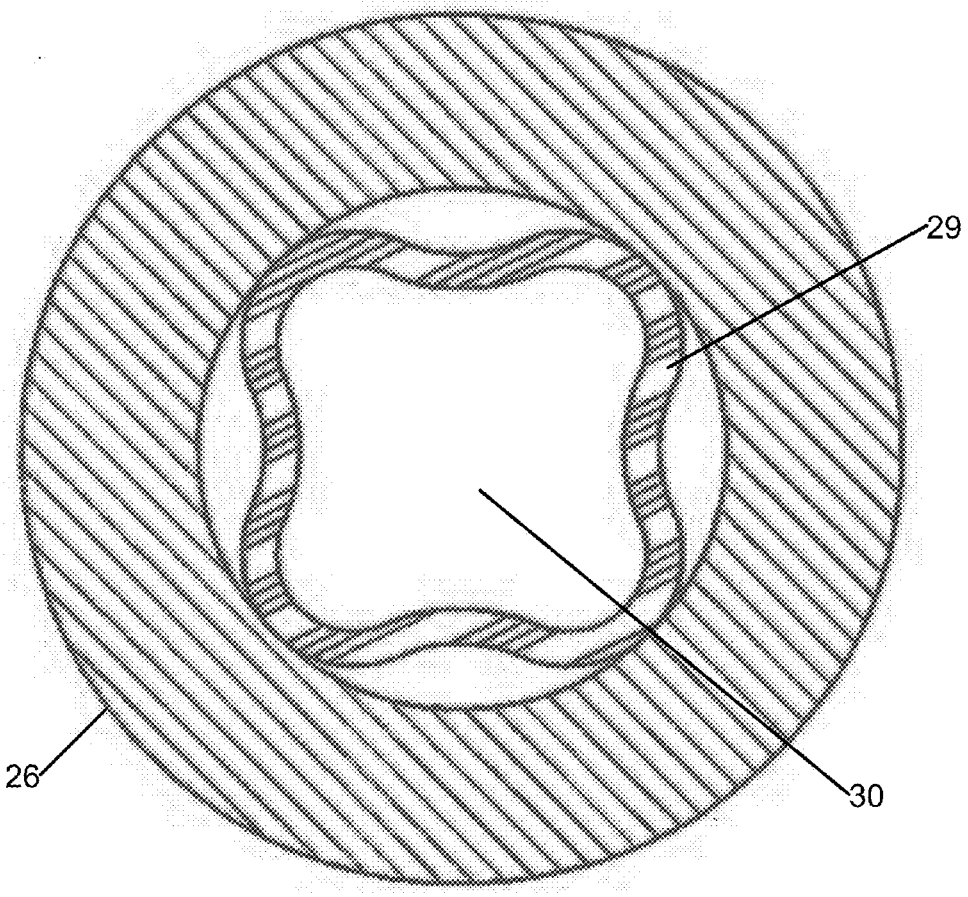
FIG. 2C is a view taken in section along the line 2C-2C of FIG. 2B.

FIGS. 2 and 2A show a downhole assembly 25 comprising an electronics package 22 supported within a bore 27 in a section 26 of drill string. Section 26 may, for example, comprise a drill collar, a gap sub or the like. Electronics package 22 is smaller in diameter than bore 27. Electronics package is centralized within bore 27 by a tubular centralizer 28. FIGS. 2B and 2C show the downhole assembly 25 without the electronics package 22.

Centralizer 28 comprises a tubular body 29 having a bore 30 for receiving electronics package 22 and formed to provide axially-extending inner support surfaces 32 for supporting electronics package 22 and outer support surfaces 33 for bearing against the wall of bore 27 of section 26. As shown in FIG. 2A, centralizer 28 divides the annular space surrounding electronics package 22 into a number of axial channels. The axial channels include inner channels 34 defined between centralizer 28 and electronics package 22 and outer channels 36 defined between centralizer 28 and the wall of section 26.

Centralizer 28 may be provided in one or more sections and may extend substantially continuously for any desired length along electronics package 22. In some embodiments, centralizer 28 extends substantially the full length of electronics package 22. In some embodiments, centralizer 28 extends to support electronics package 22 substantially continuously along at least 60% or 70% or 80% of an unsupported portion of electronics package 22 (e.g. a portion of electronics package 22 extending from a point at which electronics package 22 is coupled to section 26 to an end of electronics package 22. In some embodiments centralizer 28 engages substantially all of the unsupported portion of electronics package 22. Here, 'substantially all' means at least 95%.

In the illustrated embodiment, inner support surfaces 32 are provided by the ends of inwardly-directed longitudinally-extending lobes 37 and outer support surfaces 33 are provided by the ends of outwardly-directed longitudinally-extending lobes 38. The number of lobes may be varied. The illustrated embodiment has four lobes 37 and four lobes 38. However, other embodiments may have more or fewer lobes. For example, some alternative embodiments have 3 to 8 lobes 38.

It is convenient but not mandatory to make the lobes of centralizer 28 symmetrical to one another. It is also convenient but not mandatory to make the cross-section of centralizer 28 mirror symmetrical about an axis passing through one of the lobes. It is convenient but not mandatory for lobes 37 and 38 to extend parallel to the longitudinal axis of centralizer 28. In the alternative, centralizer 28 may be formed so that lobes 37 and 38 are helical in form.

Centralizer 28 may be made from a range of materials from metals to plastics suitable for exposure to downhole conditions. Some non-limiting examples are suitable thermoplastics, elastomeric polymers, rubber, copper or copper alloy, alloy steel, and aluminum. For example centralizer 28 may be made from a suitable grade of PEEK (Polyetheretherketone) or PET (Polyethylene terephthalate) plastic.

Where centralizer 28 is made of plastic the plastic may be fiber-filled (e.g. with glass fibers) for enhanced erosion resistance, structural stability and strength.

The material of centralizer 28 should be capable of withstanding downhole conditions without degradation. The ideal material can withstand temperature of up to at least 150 C (preferably 175 C or 200 C or more), is chemically resistant or inert to any drilling fluid to which it will be exposed, does not absorb fluid to any significant degree and resists erosion by drilling fluid. In cases where centralizer 28 contacts metal of electronics package 22 and/or bore 27 (e.g. where one or both of electronics package 22 and bore 27 is uncoated) the material of centralizer 28 is preferably not harder than the metal of electronics package 22 and/or section 26 that it contacts. Centralizer 28 should be stiff against deformations so that electronics package 22 is kept concentric within bore 27. The material characteristics of centralizer 28 may be uniform.

The material of centralizer 28 may also be selected for compatibility with sensors associated with electronics package 22. For example, where electronics package 22 includes a magnetometer, it is desirable that centralizer 28 be made of a non-magnetic material such as copper, beryllium copper, or a suitable thermoplastic.

In cases where centralizer 28 is made of a relatively unyielding material, a layer of a vibration damping material such as rubber, an elastomer, a thermoplastic or the like may be provided between electronics package 22 and centralizer 28 and/or between centralizer 28 and bore 27. The vibration damping material may assist in preventing 'pinging' (high frequency vibrations of electronics package 22 resulting from shocks).

Centralizer 28 may be formed by extrusion, injection molding, casting, machining, or any other suitable process. Advantageously the wall thickness of centralizer 28 can be substantially constant. This facilitates manufacture by extrusion. In the illustrated embodiment the lack of sharp corners reduces the likelihood of stress cracking, especially when centralizer 28 has a constant or only slowly changing wall thickness. In an example embodiment, the wall of centralizer 28 has a thickness in the range of 0.1 to 0.3 inches (2½ to 7½ mm). In a more specific example embodiment, the wall of centralizer 28 is made of a thermoplastic material (e.g. PET or PEEK) and has a thickness of about 0.2 inches (about 5 mm).

Since centralizer 28 may cooperate with drilling fluid within bore 27 to damp undesired motions of electronics package 22, centralizer 28 may be designed with reference to the type of fluid that will be used in drilling. For air drilling, centralizer 28 may be made with thicker walls and/or made of a stiffer material so that it can hold electronics package 22 against motions in the absence of an incompressible drilling fluid. Conversely, the presence of drilling fluid in channels 34 and 36 tends to dampen high-frequency vibrations and to cushion transverse motions of electronics package 22. Consequently, a centralizer 28 for use with drilling fluids may have thinner walls than a centralizer 28 designed for use while air drilling.

Centralizer 28 is preferably sized to snuggly grip electronics package 22. Preferably insertion of electronics package 22 into centralizer 28 resiliently deforms the material of centralizer 28 such that centralizer 28 grips the outside of electronics package 22 firmly. Electronics package 22 may be somewhat larger in diameter than the space between the innermost parts of centralizer 28 to provide an interference fit between the electronics package and centralizer 28. The size of the interference fit is an engineering detail but may be ½ mm or so (a few hundredths of an inch).

In some applications it is advantageous for the material of centralizer 28 to be electrically insulating. For example, where electronics package 22 comprises an EM telemetry system, providing an electrically-insulating centralizer 28 can prevent the possibility of short circuits between section 26 and the outside of electronics package 22 as well as increase the impedance of current paths through drilling fluid between electronics package 22 and section 26.

Electronics package 22 may be locked against axial movement within bore 27 in any suitable manner. For example, by way of pins, bolts, clamps, or other suitable fasteners. In the embodiment illustrated in FIG. 2, a spider 40 having a rim 40A supported by arms 40B is attached to electronics package 22. Rim 40A engages a ledge 41 formed at the end of a counterbore within bore 27. Rim 40A is clamped tightly against ledge 41 by a nut 44 (see FIGS. 3 and 3A) that engages internal threads on surface 42.

In some embodiments, centralizer 28 extends from spider 40 or other longitudinal support system for electronics package 22 continuously to the opposing end of electronics package 22. In other embodiments one or more sections of centralizer 28 extend to grip electronics package 22 over at least 70% or at least 80% or at least 90% or at least 95% of a distance from the longitudinal support to the opposing end of electronics package 22.

In some embodiments electronics package 22 has a fixed rotational orientation relative to section 26. For example, in some embodiments spider 40 is keyed, splined, has a shaped bore that engages a shaped shaft on the electronics package 22 or is otherwise non-rotationally mounted to electronics package 22. Spider 40 may also be non-rotationally mounted to section 26, for example by way of a key, splines, shaping of the face or edge of rim 40A that engages corresponding shaping within bore 27 or the like.

In some embodiments electronics package 22 has two or more spiders, electrodes, or other elements that directly engage section 26. For example, electronics package 22 may include an EM telemetry system that has two spaced apart electrical contacts that engage section 26. In such embodiments, centralizer 28 may extend for a substantial portion of (e.g. at least 50% or at least 65% or at least 75% or at least 80% or substantially the full length of) electronics package 22 between two elements that engage section 26.

Figure 3:
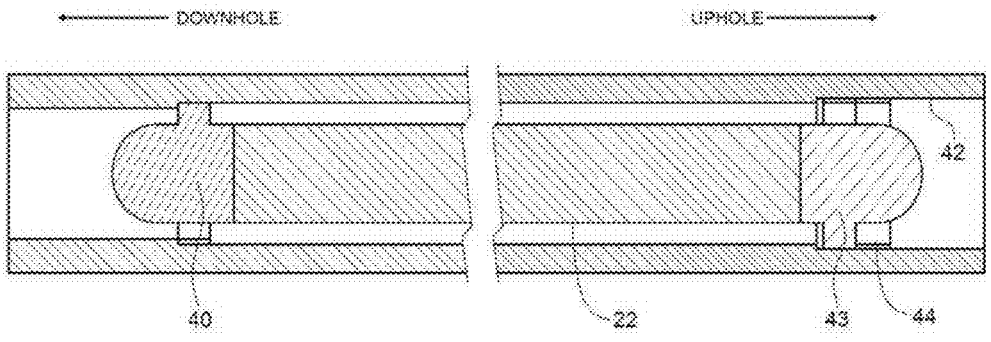
FIG. 3 is a schematic illustration of one embodiment of the invention where an electronic package is supported between two spiders.

In an example embodiment shown in FIG. 3, electronics package 22 is supported between two spiders 40 and 43. Each spider 40 and 43 engages a corresponding landing ledge within bore 27. Each spider 40 and 43 may be non-rotationally coupled to both electronics package 22 and bore 27. Centralizer 28 may be provided between spiders 40 and 43. Optionally spiders 40 and 43 are each spaced longitudinally apart from the ends of centralizer 28 by a short distance (e.g. up to about ½ meter (18 inches) or so) to encourage laminar flow of drilling fluid past electronics package 22.

It can be seen from FIG. 2A that, in cross section, the wall 29 of centralizer 28 extends around electronics package 22. Wall 29 is shaped to provide outwardly projecting lobes 38 that are outwardly convex and inwardly concave as well as inwardly-projecting lobes 37 that are inwardly convex and outwardly concave. In the illustrated embodiment, each outwardly projecting lobe 38 is between two neighbouring inwardly projecting lobes 37 and each inwardly projecting lobe 37 is between two neighbouring outwardly projecting lobes 38. The wall of centralizer 28 is sinuous and may be constant in thickness to form both inwardly projecting lobes 37 and outwardly projecting lobes 38.

In the illustrated embodiment, portions of the wall 29 of centralizer 28 bear against the outside of the electronics package 22 and other portions of the wall 29 of centralizer 28 bear against the inner wall of the bore 27 of section 26. As one travels around the circumference of centralizer 28, centralizer 28 makes alternate contact with electronics package 22 on the internal aspect of wall 29 of centralizer 28 and with section 26 on the external aspect of centralizer 28. Wall 29 of centralizer 28 zig zags back and forth between electronics package 22 and the wall of bore 27 of section 26. In the illustrated embodiment the parts of the wall 29 of centralizer 28 that extend between an area of the wall that contacts electronics package 22 and a part of wall 29 that contacts section 26 are curved. These curved wall parts are preloaded such that centralizer 28 exerts a compressive force on electronics package 22 and holds electronics package 22 centralized in bore 27.

When section 26 experiences a lateral shock, centralizer 28 cushions the effect of the shock on electronics package 22 and also prevents electronics package 22 from moving too much away from the center of bore 27. After the shock has passed, centralizer 28 urges the electronics package 22 back to a central location within bore 27. The parts of the wall 29 of centralizer 28 that extend between an area of the wall that contacts electronics package 22 and an area of the wall that contacts section 26 can dissipate energy from shocks and vibrations into the drilling fluid that surrounds them. Furthermore, these wall sections are pre-loaded and exert restorative forces that act to return electronics package 22 to its centralized location after it has been displaced.

As shown in FIG. 2A, centralizer 28 divides the annular space within bore 27 surrounding electronics package 22 into a first plurality of inner channels 34 inside the wall 29 of centralizer 28 and a second plurality of outer channels 36 outside the wall 29 of centralizer 28. Each of inner channels 34 lies between two of outer channels 36 and is separated from the outer channels 36 by a part of the wall of centralizer 28. One advantage of this configuration is that the curved, pre-tensioned flexed parts of the wall tend to exert a restoring force that urges electronics package 22 back to its equilibrium (centralized) position if, for any reason, electronics package 22 is moved out of its equilibrium position. The presence of drilling fluid in channels 34 and 36 tends to damp motions of electronics package 22 since transverse motion of electronics package 22 results in motions of portions of the wall of centralizer 28 and these motions transfer energy into the fluid in channels 34 and 36. In addition, dynamics of the flow of fluid through channels 34 and 36 may assist in stabilizing centralizer 28 by carrying off energy dissipated into the fluid by centralizer 28.

The preloaded parts of wall 29 provide good mechanical coupling of the electronics package 22 to the drill string section 26 in which the electronics package 22 is supported. Centralizer 28 may provide such coupling along the length of the electronics package 22. This good coupling to the drill string section 26, which is typically very rigid, can increase the resonant frequencies of the electronics package 22, thereby making the electronics package 22 more resistant to being damaged by high amplitude low frequency vibrations that typically accompany drilling operations.

Figure 4:
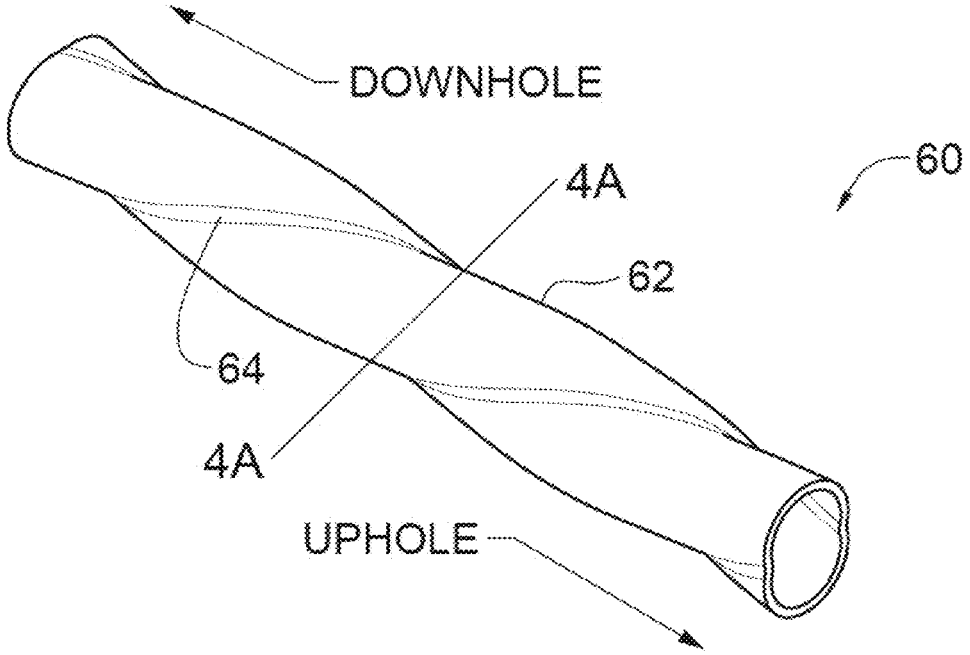
FIG. 4 is a perspective view of a centralizer according to one embodiment of the invention.
Figure 4A:
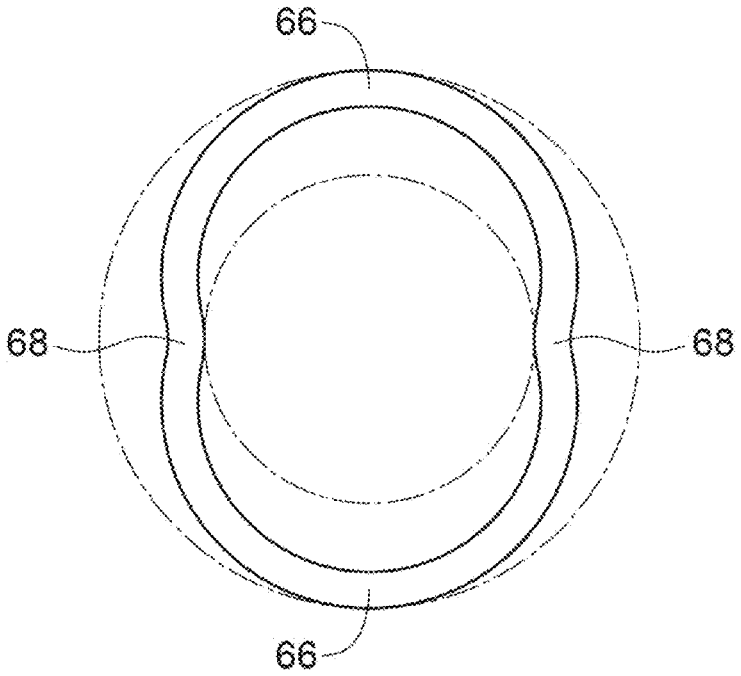
FIG. 4A is a view taken in section along the line 4A-4A of FIG. 4.

FIGS. 4 and 4A show an example centralizer 60 formed with a wall 62 configured to provide longitudinal ridges 64 that twist around the longitudinal centerline of centralizer 60 to form helixes. In the illustrated embodiment, centralizer 60 has a cross-sectional shape in which wall 62 forms two outwardly projecting lobes 66, which are each outwardly convex and inwardly concave and two inwardly projecting lobes 68. Centralizers configured to have other numbers of lobes may also be made to have a helical twist. for example, centralizers that, in cross section, provide 3 to 8 lobes may be constructed so that the lobes extend along helical paths.

Inwardly-projecting lobes 68 are configured to grip an electronics package by spiralling around the outer surface of the electronics package. The tubular body of centralizer 28 is subject to a twist so that the lobes become displaced in a rotated or angular fashion as one traverses along the length of centralizer 28. At each point along the electronics package 22 the electronics package 22 is held between two opposing lobes 68. The orientation of lobes 68 is different for different positions along the electronics package so that the electronics package is held against radial movement within the bore of centralizer 60. Each lobe 64 makes at least a half twist over the length of centralizer 60. In some embodiments, each lobe 64 makes at least one full twist around the longitudinal axis of centralizer 60 over the length of centralizer 60.

Figure 3B:
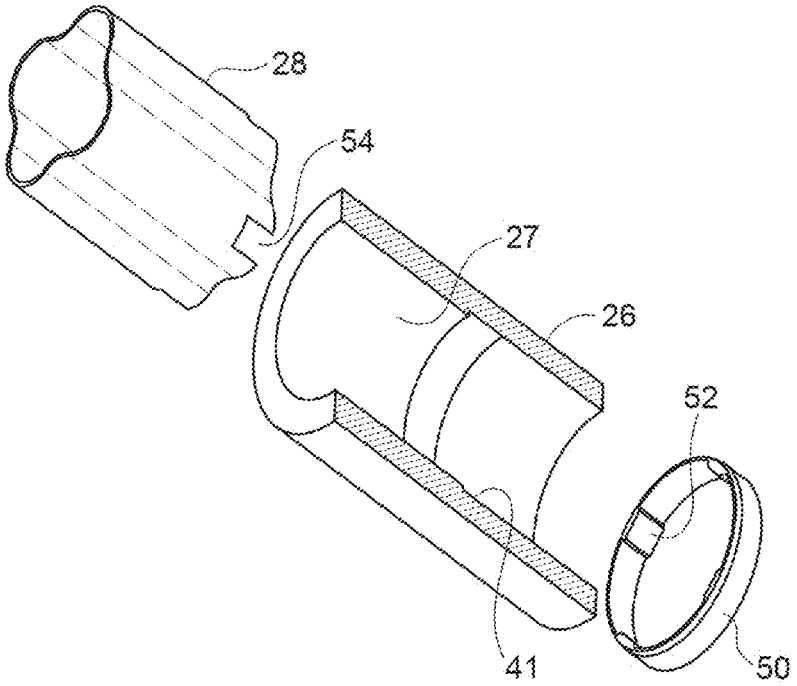
FIG. 3B is an exploded view showing one way to anchor a centralizer against rotation in the bore of a drill string.
Figure 3A:
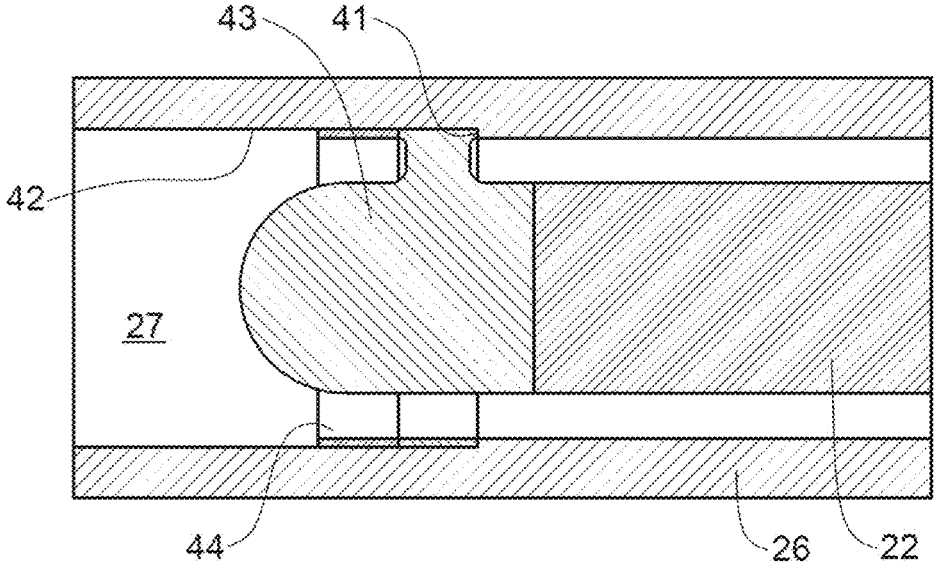
FIG. 3A is a detail showing one assembly for anchoring a downhole probe against longitudinal movement.

A centralizer as described herein may be anchored against longitudinal movement and/or rotational movement within bore 27 if desired. For example the centralizer may be keyed onto a landing shoulder in bore 27 and held axially in place by a threaded feature that locks it down. For example, the centralizer may be gripped between the end of one drill collar and a landing shoulder. FIG. 3B illustrates an example embodiment wherein a centralizer 28 engages features of a ring 50 that is held against a landing 41 within bore 27 of section 26. In the illustrated embodiment, notches 54 on an end of centralizer 28 engage corresponding teeth on ring 50. Ring 50 may be held in place against landing 41 by means of a suitable nut, the end of an adjoining drill string section, a spider or other part of a probe or the like. In some embodiments, ring 50 is attached to or is part of a spider that supports a downhole probe in bore 27.

A centralizer as described herein may optionally interface non-rotationally to an electronics package 22 (for example, the electronics package 22 may have features that project to engage between inwardly-projecting lobes of a centralizer) so that the centralizer provides enhanced damping of torsional vibrations of the electronics package 22.

One method of use of a centralizer as described herein is to insert the centralizer into a section of a drill string such as a gap sub, drill collar or the like. The section has a bore having a diameter D1. The centralizer, in an uninstalled configuration free of external stresses prior to installation, has outermost points lying on a circle of diameter D2 with D2>D1. The method involves inserting the centralizer into the section. In doing so, the outermost points of the centralizer bear against the wall of the bore of the section and are therefore compressed inwardly. The configuration of centralizer 28 allows this to occur so that centralizer 28 may be easily inserted into the section. Insertion of centralizer 28 into the section moves the innermost points of centralizer 28 inwardly.

In some embodiments, centralizer 28 is inserted into the section until the end being inserted into the section abuts a landing step in the bore of the section. The centralizer may then be constrained against longitudinal motion by providing a member that bears against the other end of the centralizer. For example, the section may comprise a number of parts (e.g. a number of collars) that can be coupled together. The centralizer may be held between the end of one collar or other part of the section and a landing step.

After installation of the centralizer into the section, the innermost points on the centralizer lie on a central circle having a diameter D3. An electronics package or other elongated object to be centralized having a diameter D4 with D4>D3 may then be introduced longitudinally into centralizer. This forces the innermost portions of centralizer outwardly and preloads the sections of the wall of centralizer that extend between the innermost points and the outermost points of centralizer. After the electronics package has been inserted, the electronics package may be anchored against longitudinal motion.

In some applications, as drilling progresses, the outer diameter of components of the drill string may change. For example, a well bore may be stepped such that the wellbore is larger in diameter near the surface than it is in its deeper portions. At different stages of drilling a single hole, it may be desirable to install the same electronics package in drill string sections having different dimensions. Centralizers as described herein may be made in different sizes to support an electronics package within bores of different sizes. Centralizers as described herein may be provided at a well site in a set comprising centralizers of a plurality of different sizes. The centralizers may be provided already inserted into drill string sections or not yet inserted into drill string sections.

Moving a downhole probe or other electronics package into a drill string section of a different size may be easily performed at a well site by removing the electronics package from one drill string section, changing a spider or other longitudinal holding device to a size appropriate for the new drill string section and inserting the electronics package into the centralizer in the new drill string section.

For example, a set comprising: spiders or other longitudinal holding devices of different sizes and centralizers of different sizes may be provided. The set may, by way of non-limiting example, comprise spiders and centralizers dimensioned for use with drill collars having bores of a plurality of different sizes. For example, the spiders and centralizers may be dimensioned to support a given probe in the bores of drill collars of any of a number of different standard sizes. The set of centralizers may, for example include centralizers sufficient to support a given probe in any of a defined plurality of differently-sized drill collars. For example, the set may comprise a selection of centralizers that facilitate supporting the probe in drill collars having outside diameters such as two or more of: 4¾ inches, 6½ inches, 8 inches, 9½ inches and 11 inches. The drill collars may have industry-standard sizes. The drill collars may collectively include drill collars of two, three or more different bore diameters. The centralizers may, by way of non-limiting example, be dimensioned in length to support probes having lengths in the range of 2 to 20 meters.

In some embodiments the set comprises, for each of a plurality of different sizes of drill string section, a plurality of different sections of centralizer that may be used together to support a downhole probe of a desired length. By way of non-limiting example, two 3 meter long sections of centralizer may be provided for each of a plurality of different bore sizes. The centralizers may be used to support 6 meters of a downhole probe.

Embodiments as described above may provide one or more of the following advantages. Centralizer 28 may extend for the full length of the electronics package 22 or any desired part of that length. Centralizer 28 positively prevents electronics package 22 from contacting the inside of bore 27 even under severe shock and vibration. The cross-sectional area occupied by centralizer 28 can be relatively small, thereby allowing a greater area for the flow of fluid past electronics package 22 than would be provided by some other centralizers that occupy greater cross-sectional areas. Centralizer 28 can dissipate energy from shocks and vibration into the fluid within bore 27. The geometry of centralizer 28 is self-correcting under certain displacements. For example, restriction of flow through one channel tends to cause forces directed so as to open the restricted channel. Especially where centralizer 28 has four or more inward lobes, electronics package 22 is mechanically coupled to section 26 in all directions, thereby reducing the possibility for localized bending of the electronics package 22 under severe shock and vibration. Reducing local bending of electronics package 22 can facilitate longevity of mechanical and electrical components and reduce the possibility of catastrophic failure of the housing of electronics assembly 22 or components internal to electronics package 22 due to fatigue. Centralizer 28 can accommodate deviations in the sizing of electronics package 22 and/or the bore 27 of section 26. Centralizer 28 can accommodate slick electronics packages 22 and can allow an electronics package 22 to be removable while downhole (since a centralizer 28 can be made so that it does not interfere with withdrawal of an electronics package 22 in a longitudinal direction). Centralizer 28 can counteract gravitational sag and maintain electronics package 22 central in bore 27 during directional drilling or other applications where bore 27 is horizontal or otherwise non-vertical.

Apparatus as described herein may be applied in a wide range of subsurface drilling applications. For example, the apparatus may be applied to support downhole electronics that provide telemetry in logging while drilling ('LWD') and/or measuring while drilling ('MWD') telemetry applications. The described apparatus is not limited to use in these contexts, however.

One example application of apparatus as described herein is directional drilling. In directional drilling the section of a drill string containing a downhole probe may be non-vertical. A centralizer as described herein can maintain the downhole probe centered in the drill string against gravitational sag, thereby maintaining sensors in the downhole probe true to the bore of the drill string.

A wide range of alternatives are possible. For example, it is not mandatory that section 26 be a single component. In some embodiments section 26 comprises a plurality of components that are assembled together into the drill string (e.g. a plurality of drill collars). Centralizer 28 is not necessarily entirely formed in one piece. In some embodiments, additional layers are added to the wall of centralizer 28 to enhance stiffness, resistance to abrasion or other mechanical properties. The wall thickness of centralizer 28 may be varied to adjust mechanical properties of centralizer 28. Apertures or holes may be formed in the wall of the centralizer to allow fluid flow or to provide for other components to pass through the wall of the centralizer.

INTERPRETATION OF TERMS

Unless the context clearly requires otherwise, throughout the description and the claims:

"comprise," "comprising," and the like are to be construed in an inclusive sense, as opposed to an exclusive or exhaustive sense; that is to say, in the sense of "including, but not limited to".

"connected," "coupled," or any variant thereof, means any connection or coupling, either direct or indirect, between two or more elements; the coupling or connection between the elements can be physical, logical, or a combination thereof.

"herein," "above," "below," and words of similar import, when used to describe this specification shall refer to this specification as a whole and not to any particular portions of this specification.

"or," in reference to a list of two or more items, covers all of the following interpretations of the word: any of the items in the list, all of the items in the list, and any combination of the items in the list.

the singular forms "a", "an" and "the" also include the meaning of any appropriate plural forms.

Words that indicate directions such as "vertical", "transverse", "horizontal", "upward", "downward", "forward", "backward", "inward", "outward", "left", "right", "front", "back", "top", "bottom", "below", "above", "under", and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, drill string component, drill rig system etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

What is claimed is:

1. A centralizer for use in subsurface drilling, the centralizer comprising:

an elongated tubular member having a wall formed to provide a cross-section that provides first outwardly-convex and inwardly-concave lobes, the first lobes arranged to contact a bore wall of a bore in a section of drill string at a plurality of spots spaced apart around a circumference of the bore wall; and a plurality of inwardly-projecting portions, each of the plurality of inwardly-projecting portions arranged between two adjacent ones of the plurality of first lobes.

2. A centralizer according to claim 1 wherein the inwardly-projecting portions comprise inwardly-projecting lobes that are inwardly-convex and outwardly-concave.

3. A centralizer according to claim 2 wherein the inwardly-projecting lobes are mirror symmetrical about an axis passing through a longitudinal centerline of the centralizer.

4. A centralizer according to claim 2 wherein a thickness of the wall is substantially uniform.

5. A centralizer according to claim 3 wherein the wall has a thickness in the range of about 0.1 to 0.3 inches.

6. A centralizer according to claim 4 wherein the wall has a thickness of 0.15 to 0.25 inches.

7. A centralizer according to claim 2 wherein, in cross-section the centralizer has 4-fold rotational symmetry.

8. A centralizer according to claim 1 wherein the cross-section provides four first lobes.

9. A centralizer according to claim 1 wherein the cross-section provides two to eight first lobes.

10. A centralizer according to claim 1 wherein each of the plurality of first lobes is mirror symmetrical about an axis passing through a longitudinal centerline of the centralizer.

11. A centralizer according to claim 1 wherein the first lobes are equally angularly separated around a longitudinal centerline of the centralizer.

12. A centralizer according to claim 1 wherein the first lobes provide longitudinally-extending ridges on an outer surface of the centralizer.

13. A centralizer according to claim 12 wherein the longitudinally-extending ridges are parallel to a longitudinal centerline of the centralizer.

14. A centralizer according to claim 12 wherein the longitudinally-extending ridges twist in helices around the longitudinal centerline of the centralizer.

15. A centralizer according to claim 1 wherein the wall of the centralizer comprises a thermoplastic material.

16. A centralizer according to claim 15 wherein the thermoplastic material comprises a fiber-filled thermoplastic material.

17. A centralizer according to claim 16 wherein the thermoplastic material comprises PEEK or PET.

18. A centralizer according to claim 1 wherein the wall is made of an electrically insulating material.

19. A centralizer according to claim 1 wherein the wall is made of an electrically conductive material.

20. A centralizer according to claim 1 wherein the wall is made of a composite of electrically conductive and electrically-insulating materials.

21. A centralizer for use in subsurface drilling, the centralizer comprising:

an elongated tubular member having a wall formed to provide a cross-section that provides first outwardly-convex and inwardly-concave lobes, the first lobes arranged to contact a bore wall of a bore in a section of drill string at a plurality of spots spaced apart around a circumference of the bore wall; and a plurality of inwardly-projecting portions, each of the plurality of inwardly-projecting portions arranged between two adjacent ones of the plurality of first lobes wherein each of the plurality of first lobes has a radius of curvature that is less than a radius of a smallest circle enclosing the centralizer.

22. A downhole assembly comprising:

a drill string section having a bore extending longitudinally through the drill string section;

a downhole probe located in the bore of the section; and, a centralizer in the bore, the centralizer comprising a tubular member having a wall extending around the downhole probe, the wall formed to contact an inside surface of the bore and an outside surface of the downhole probe, a cross-section of the wall following a path around the downhole probe that zig zags back and forth between the outside surface of the downhole probe and the inside surface of the bore wall.

23. A downhole assembly according to claim 22 wherein the wall divides an annular region within the bore surrounding the downhole probe into a plurality of channels, a first plurality of the channels being inside the wall of the centralizer and a second plurality of the channels being outside the wall of the centralizer.

24. A downhole assembly according to claim 22 wherein the downhole probe comprises an electronics package.

25. A downhole assembly according to claim 22 wherein the downhole probe comprises a metal housing and the metal housing is harder than a material of the centralizer wall.

26. A downhole assembly according to claim 22 wherein the downhole probe comprises a telemetry signal generator.

27. A downhole assembly according to claim 22 wherein following the path around the cross section, the path has inner portions that contact the outside of the downhole probe but do not contact the inside of the bore that alternate with outer portions that contact the inside surface of the bore but do not contact the downhole probe.

28. A downhole assembly according to claim 27 wherein the inner and outer portions of the path are connected by connecting portions of the path that extend through the bore.

29. A downhole assembly according to claim 28 wherein the connecting portions are curved.

30. A downhole assembly according to claim 28 wherein the connecting portions have compound curvature.

31. A downhole assembly according to claim 22 wherein the wall of the centralizer is formed to provide a cross-section that provides:

first outwardly-convex and inwardly-concave lobes, the first lobes contacting a bore wall of the bore of the drill string section at a plurality of spots spaced apart around a circumference of the bore wall; and a plurality of inwardly-projecting portions, each of the plurality of inwardly-projecting portions arranged between two adjacent ones of the plurality of first lobes.

32. A downhole assembly according to claim 31 wherein, in the centralizer, the inwardly-projecting portions comprise inwardly-projecting lobes that are inwardly-convex and outwardly-concave.

33. A downhole assembly comprising:

a drill string section having a bore extending longitudinally through the drill string section;

a downhole probe located in the bore of the section; and, a centralizer in the bore, the centralizer comprising a tubular member having a wall extending around the downhole probe, the wall formed to contact an inside surface of the bore and an outside surface of the downhole probe, a cross-section of the wall following a path around the downhole probe that zig zags back and forth between the outside surface of the downhole probe and the inside surface of the bore wall wherein the downhole probe comprises a layer of a vibration damping material between a housing of the downhole probe and the centralizer.

* * * * *